US005851414A

United States Patent [19]

Ando et al.

[11] Patent Number: 5,851,414

[45] Date of Patent: Dec. 22, 1998

[54] TUNDISH STOPPER ROD FOR CONTINUOUS CASTING

[75] Inventors: Mitsuru Ando; Hisatake Okumura, both of Gifu-ken, Japan

[73] Assignee: Akechi Ceramics Kabushiki Kaisha, Japan

[21] Appl. No.: 639,560

[22] Filed: Apr. 29, 1996

[51] Int. Cl.[6] ..... B22D 41/08

[52] U.S. Cl. ..... 222/602; 266/271

[58] Field of Search ..... 266/271, 236; 222/602

[56] References Cited

U.S. PATENT DOCUMENTS 4,691,901 9/1987 Dobner ..... 266/236
4,946,083 8/1990 Fishler et al. ..... 222/602
5,259,596 11/1993 Ruffaldi ..... 222/602

*Primary Examiner*—Scott Kastler
*Attorney, Agent, or Firm*—Carol I. Bordas

[57] ABSTRACT

The object of the present invention is to provide a tundish stopper rod for continuous casting which can be fitted onto a spindle correctly in a short time and which has a sufficiently high degree of heat resistance and mechanical strength to endure its harsh operating conditions.

A tundish stopper rod for continuous casting according to the present invention comprises:

(a) a stopper rod for regulating the flow rate of molten metal being supported by a spindle and being made of a refractory material, and (b) a nut for attaching the stopper rod onto the spindle, the nut being made of an engineering ceramic material and being embedded in a body of the stopper rod.

10 Claims, 4 Drawing Sheets

TUNDISH STOPPER ROD FOR CONTINUOUS CASTING

FIELD OF THE INVENTION

The present invention relates to a tundish stopper rod for continuous casting which regulates the flow rate of molten metal which is poured from a tundish into a mold during continuous casting of metal e.g., steel, a copper alloy, an aluminum alloy or the like.

BACKGROUND AND DESCRIPTION OF RELATED ART

In a continuous casting process, molten metal is stored in a tundish which is located above a mold of a continuous casting apparatus and, then, this molten metal is poured from the tundish into the mold at a flow rate suitable for its casting conditions. A tundish stopper rod is used in order to regulate the flow rate of the molten metal being cast from the tundish into the mold.

FIG. 4 shows a tundish stopper rod and a tundish nozzle both located within a tundish. As shown in this figure, a tundish stopper rod 1 is supported in a vertical position by a spindle 2. According to the movement of a lever 30, this tundish stopper rod moves up-and-down in a vertical direction and varies the flow rate of a molten metal being poured into a mold 50. Generally an immersion nozzle 40 is connected to the tundish nozzle 4.

The lower end of the tundish stopper rod is called a stopper head and is formed in a dome-like or fusiform shape. The upper portion of the tundish stopper rod is called a sleeve and has a cylindrical shape. As a tundish stopper rod of this type, a single-piece stopper rod in which a stopper rod head and a sleeve are made integrally or a separable two-piece stopper rod in which a stopper head and a sleeve are made respectively, is used.

A tundish stopper rod is exposed to high-temperature molten metal and, thus, must be made of a refractory material. A spindle is made of steel because it must have a high degree of physical strength and a tight dimensional tolerances. Furthermore, the tundish stopper rod must withstand the erosion and corrosion caused by a molten metal like molten steel and by slag.

The tundish stopper rod may be moved up-and-down vigorously in order to remove the nozzle blockage caused by the inclusions contained in molten metal. Thus, it must also resist the impact resulting from such vigorous up-and-down movement.

For the single-piece tundish stopper rod described above, the fitting portion between the stopper rod and the spindle is located within the sleeve. For the separable two-piece tundish stopper rod, the fitting portion between the stopper rod and the spindle is located only within the stopper head. In a conventional tundish stopper rod, the stopper rod and the spindle are bonded together through the use of mortar or joined together by the use of a metal nut embedded in the stopper rod. FIG. 3 shows a known joining structure of the fitting portion which can be obtained with the use of mortar.

As shown in this figure, the stopper rod 1 has an inside threaded portion in which the threads can engage with the corresponding threads of the spindle 2. This stopper rod is screwed onto the spindle when it is to be used. Since such a stopper rod is made of a refractory material and, therefore, its dimensional tolerances are insufficient, undesired space between the stopper rod and the spindle cannot be avoided. In order to compensate for this undesired space, mortar 3 is applied between the stopper rod and the spindle.

However, even by using the mortar, it is difficult to fill this undesired space uniformly and this makes it impossible to properly hold the stopper rod in an exact vertical position within the tundish. Accordingly, the stopper rod cannot be aligned with the hole of the tundish and it is difficult to suitably control the flow rate of the molten metal poured into the mold.

Furthermore, it takes about 10 minutes to attach the stopper rod onto the spindle and the mortar must be cured for about 10 hours in order to obtain its appropriate fixing. In addition to this, since the mechanical strength of the mortar is very low and there exist such points where the stopper rod is in direct contact with the spindle, the stopper rod can be damaged easily under its operating conditions. Particularly, because of the harsh up-and-down movement of the stopper rod, breakage and thermal spalling of the stopper rod takes place in many cases.

In order to take countermeasures against this problem, a tundish stopper rod is used, as necessary, which is integrally molded with a steel nut embedded in it. As described above, since a tundish stopper rod must bear rigorous thermal, chemical and mechanical conditions, it has been recommended that a tundish stopper rod used for continuous casting of molten metal is made of alumina-graphite refractory containing about 25 wt % graphite so that the tundish stopper rod can resist these rigorous conditions.

When this alumina-graphite refractory is used as a material of a tundish stopper rod integrally molded with a steel nut embedded in it, various problems can arise. For example, when the casting duration is long, the carbon contained in the graphite can penetrate into the steel nut, reduce the melting point of the steel material of the steel nut and, thus, cause the deformation of the threads of the steel nut during the casting of a molten metal such as liquid steel. Furthermore, in this tundish stopper rod in which the steel nut is embedded, the difference between the thermal expansion coefficient of the stopper rod refractory material and that of the steel nut is so large that cracks in the stopper rod may occur near the boundary between the stopper rod and the steel nut and, thus, thermal spalling of the stopper rod may take place.

Generally, a tundish stopper rod is to be replaced after using it for several charges of casting. When the above-mentioned tundish stopper rod, which is integrally molded with the steel nut is used, seizure between the steel nut and the spindle may be found during the replacing of the tundish stopper rod after its usage. This seizure makes it difficult to replace the tundish stopper rod and, in addition to this, causes damage to the spindle during the removal of the tundish stopper rod from the spindle.

As described above, when mortar is used as an adhesive for attaching a tundish stopper rod onto a spindle, it is difficult to fix the tundish stopper rod onto the spindle in a proper vertical direction. Furthermore, in this case, the operation for attaching the tundish stopper rod onto the spindle is time-consuming and the fitting portion between the tundish stopper rod and the spindle cannot endure harsh thermal and mechanical conditions.

When a tundish stopper rod, integrally molded with a steel nut embedded in it, is used for continuous casting, seizure can occur between the steel nut and the spindle due to high temperatures (e.g., about 700° C. for continuous casting of molten steel) to which the tundish stopper rod is exposed during continuous casting operation.

Thus, in order to solve the above-mentioned problems, the object of the present invention is to provide a tundish stopper rod for continuous casting which has a high degree of heat resistance and mechanical strength and which does not cause damage to a spindle on which the tundish stopper rod is fitted.

SUMMARY OF INVENTION

In order to achieve this object, the present invention provides a tundish stopper rod for continuous casting as described in the following embodiments (1) to (6).

(1) According to the first embodiment of the present invention, a tundish stopper rod for continuous casting is provided, which comprises:

(a) a stopper rod for regulating the flow rate of molten metal which is poured from a tundish into a mold, said stopper rod being supported by a spindle and being made of a refractory material; and (b) a nut for attaching said stopper rod onto the spindle, the nut being made of an engineering ceramic material and being embedded in the body of the stopper rod.

This nut is made of an engineering ceramic material. This engineering ceramic material resembles the stopper rod refractory material in composition, molding conditions (e.g., sintering temperature) and the like, which makes it easier to integrally mold the stopper rod together with the nut. In addition to this, the engineering ceramic material can be precision-worked and can be molded into a female screw whose thread dimensions correspond with those of the threads of the spindle. Therefore, only by screwing the stopper rod onto the spindle, can the stopper rod be fixed onto the spindle securely, firmly and held spontaneously in a proper vertical position. This also makes it possible to reduce the operation time for fixing the stopper rod onto the spindle. As a further advantage, the nut, which is made of the engineering ceramic material, has a high degree of mechanical strength sufficient to resist the mechanical impact caused by the rigorous up-and-down movement of the stopper rod for removing the inclusion clogs in the tundish nozzle. Furthermore, local mechanical stress cannot be produced in the stopper rod.

Furthermore, the engineering ceramic material of which the nut is made has a low thermal expansion coefficient and the difference between the thermal expansion coefficient of this ceramic material and that of the stopper rod refractory material is small. Consequently, when the nut made of this ceramic material is embedded into the stopper rod, it is possible to prevent the cracks in the stopper rod from occurring in the portion near the boundary between the nut and the stopper rod body and to avert the thermal spalling of the stopper rod. Moreover, since the engineering ceramic material has a high degree of heat resistance and chemical stability, this ceramic material does not react with the steel spindle even when it is exposed to elevated temperatures for a long time. This makes it possible to avoid the degradation of the spindle's physical properties and to prevent the seizure between the stopper rod and the spindle.

(2) According to the second embodiment of the present invention, a tundish stopper rod for continuous casting as defined in the first embodiment is provided, in which the vending strength of the engineering ceramic material in which the nut is made is at least 100 MPa.

The bending strength of 100 MPa is equal to the bending strength of the spindle's steel material at the operating temperature of about 700° C. The material of the nut must have a bending strength of 100 MPa or more at 1000° C. or lower and an engineering ceramic material having a high density which can satisfy this requirement. The use of the nut made of this engineering ceramic material can make it possible to avoid the cracking and breakage of the stopper rod and the spindle due to the mechanical impact caused by the rigorous up-and-down movement of the stopper rod, which is performed for removing the inclusion clogs in the tundish nozzle.

(3) According to the third embodiment of the present invention, a tundish stopper rod for continuous casting as defined in the first and second embodiments is provided, in which an engineering ceramic having an average thermal expansion coefficient at most twice as high as that of the stopper rod's refractory material is selected for the nut.

Several kinds of refractory materials can be used as the stopper rod's material and the average thermal expansion coefficients of these refractory materials within the temperature range of ordinary temperatures to 1000° C. are about $3\times10^{-6}$/°C. to about $6\times10^{-6}$/°C. Although an engineering ceramic material generally has a low thermal expansion coefficient, certain types of such ceramic materials have thermal expansion coefficients which are slightly higher than $6\times10^{-6}$/°C. These types of engineering ceramic materials cannot be used for the nut material.

Under the working conditions of a tundish stopper rod for continuous casting, when the average thermal expansion coefficient of the ceramic material of the nut is two or more times as high as that of the stopper rod refractory material, the thermal spalling of the stopper rod may take place. Therefore, it is desired that the average thermal expansion coefficient of the ceramic material of the nut is at most two times as high as that of the stopper rod refractory material.

Herein a specific lower limit is not required for the average thermal expansion coefficient of the engineering ceramic material of the nut. The highest temperature of molten metal of continuous casting, which is the case for molten steel, is about 1500° C. Even at such an elevated temperature, the mechanical strength of engineering ceramic material exceeds those of the stopper rod material and the spindle material. Thus, even when the thermal expansion coefficient of the stopper rod material is much higher than that of the engineering ceramic material of the nut, the damage to the nut can be prevented since the nut is embedded in and integrally molded with the body of the stopper rod. Although the thermal expansion coefficient of the spindle material is higher than that of the stopper rod material, the breakage of the nut can be avoided even at that high temperature as described above, since slight clearance exists between the spindle and the nut because of the screw-on fitting of the nut and since the engineering ceramic material exceeds the spindle material in hardness and mechanical strength.

(4) According to the fourth embodiment of the present invention, a tundish stopper rod for continuous casting as defined in the third embodiment is provided, in which the engineering ceramic material of the nut is alumina, mullite, silicon carbide, silicon nitride, sialon, zirconia or a composite material thereof.

Alumina, mullite, silicon carbide, silicon nitride, sialon, zirconia and a composite material thereof have been used as industrial materials. These ceramic materials are stable in quality and can be integrally molded with the stopper rod body in a suitable manner. Thus, it is desirable to use any of these engineering ceramic materials as the material of which the nut is made.

(5) According to the fifth embodiment of the present invention, a tundish stopper rod for continuous casting as defined in the third embodiment is provided, in which the stopper rod is made of alumina-graphite.

A tundish stopper rod must have not only a high degree of heat resistance and mechanical strength at high temperatures but also appropriate erosion resistance since the tundish stopper rod is exposed to high temperature molten metal flowing down between the tundish and the stopper rod. In addition to this, it is preferable that this tundish stopper rod is made of a material which can resist the erosion by the slag covering the molten metal surface. The most suitable material of which the tundish stopper rod can be made is alumina-graphite consisting of alumina and graphite in weight proportions of about 2:1. Thus, it is more preferable that the tundish stopper rod is made of alumina-graphite and that this tundish stopper rod is integrally molded with the nut of an engineering ceramic material as defined in the third embodiment.

(6) According to the sixth embodiment of the present invention, a tundish stopper rod for continuous casting as defined in the fifth embodiment is provided, in which the engineering ceramic material is alumina.

Alumina is a chemically stable material and its mechanical strength, heat resistance and erosion resistance are suitable for use as a material of the nut. Alumina is highly compatible with alumina-graphite which can be used as the stopper rod material.

The major components of alumina are similar with those of alumina-graphite and, consequently, their sintering conditions (e.g., sintering temperatures) resemble each other. Thus, the integral molding of the stopper rod made of alumina-graphite together with the nut made of alumina can be performed easily. In addition to this, the thermal expansion coefficient of alumina is closely analogous to that of alumina-graphite and its other physical properties (e.g., specific weight, refractoriness under load and the like) are similar with those of alumina-graphite. Consequently, the nut made of alumina can easily adapt to the variation of the thermal and physical operating conditions of the tundish stopper rod. Thus, it is most preferable to use a tundish stopper rod for continuous casting which is made of an alumina-graphite refractory and which is integrally molded with an alumina nut embedded in it.

DETAILED DESCRIPTION OF THE INVENTION

Figure 1:
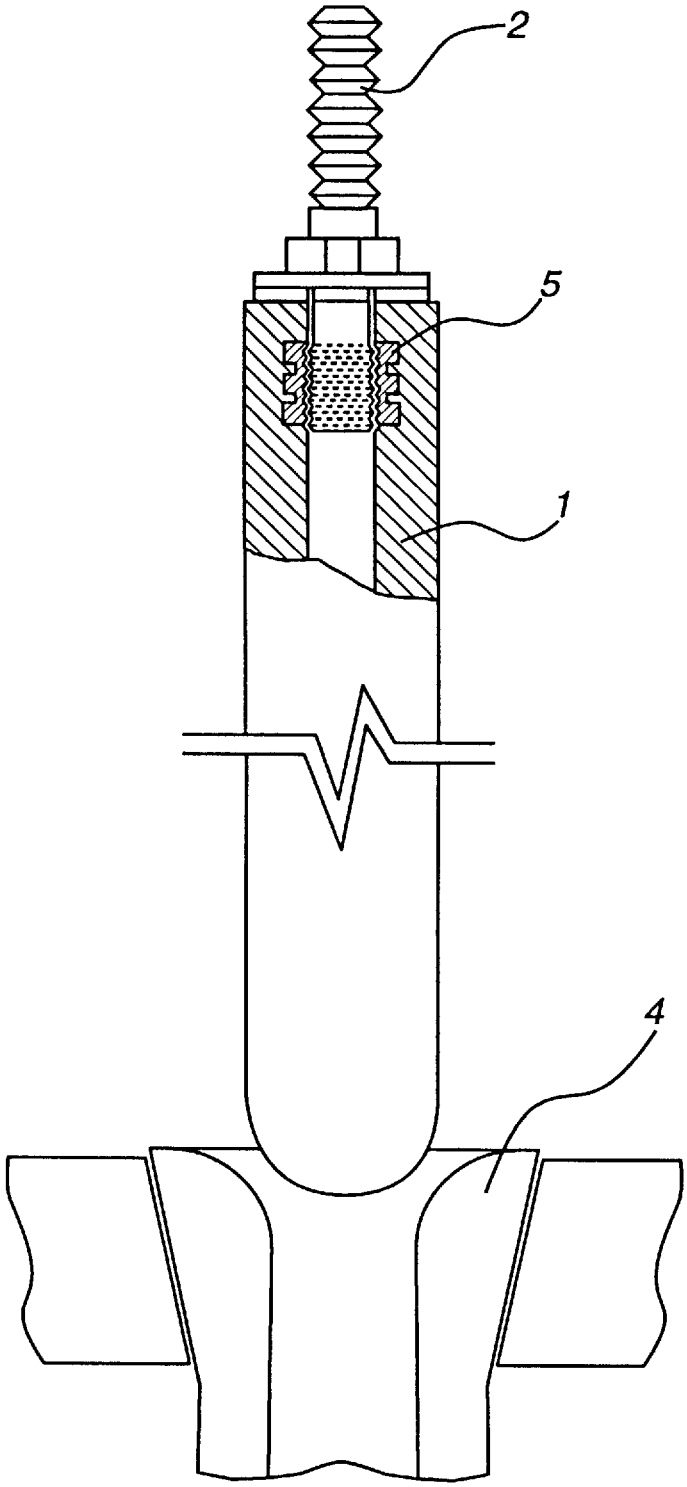
FIG. 1 is a sectional view of a tundish stopper rod for continuous casting according to the present invention.

A high alumina refractory which contains $Al_2O_3$ and $SiO_2$ and whose $Al_2O_3$ content is not less than 50 wt %, a zircon refractory which contains $ZrO_2$, $SiO_2$ as main components and $Al_2O_3$ of ten-odd wt %, or an alumina-graphite refractory or the like has been used as a refractory of a tundish stopper rod. At first, an engineering ceramic material is molded in order to form a nut. Then, the nut thus molded, is a refractory material which is to be molded into the shape of a tundish stopper rod. This refractory material in which the nut has been embedded is sintered and, thus, the tundish stopper rod is integrally molded with the nut.

The average thermal expansion coefficient of a zircon refractory is about $3\times10^{-6}$/°C. and this coefficient is relatively low among various refractory materials. Therefore, when a zircon refractory is employed as the material of the tundish stopper rod, it is preferable to use a nut made of silicon carbide or silicon nitride. The average thermal expansion coefficient of a high alumina refractory and that of an alumina-graphite refractory are about $5\times10^{-6}$/°C. and these coefficients are relatively high among various refractory materials. Therefore, when a high alumina refractory or an alumina-graphite refractory is employed as the material of the tundish stopper rod, it is preferable to use a nut made of such an engineering ceramic refractory as partially stabilized zircon, alumina, mullite or the like. Various kinds of sialons having a different average thermal expansion coefficient are commercially available as a refractory material for the nut and it is possible to select a suitable sialon whose average thermal expansion coefficient can be suited to that of the stopper rod refractory.

Hereinafter, the term "an engineering ceramic material" refers to a refractory which is made of highly refined natural or synthetic inorganic compounds having excellent physical characteristics. Any of the various sintering methods (e.g., reaction sintering, post-reaction sintering, constant pressure sintering, pressurized sintering, hot press, HIP, very high pressure sintering and the like) is used for sintering engineering ceramic material.

In terms of the physical properties, manufacture costs and mechanical strength of the ceramic materials described above, it is preferable that alumina is sintered by atmospheric pressure sintering, mullite is sintered by reaction sintering or atmospheric pressure sintering, silicon carbide is sintered by reaction sintering or atmospheric pressure sintering, silicon nitride is sintered by reaction sintering, pressurized sintering, hot press or the like, and sialon is sintered by reaction sintering.

The inside threads of the nut are formed such that they can correspond with the shapes of the spindle threads. In order to make it easier to integrate the stopper rod body and the nut, the outer shape of the nut is formed into a shape that can provide a large contact area between the stopper rod body and the nut. The stopper rod is preferably made by the use of cold isostatic pressing (CIP).

EXAMPLES

FIG. 1 illustrates an embodiment of a tundish stopper rod according to the present invention. In this figure, a nut made of an engineering ceramic material is designated by the numeral 5 and this nut is integrally molded with the body of a tundish stopper rod 1. Threads are cut on the inside surface of the nut 5 with a 3 mm pitch such that these threads can correspond with the threads of a spindle 2. Projections and depressions are formed on the outer face of this nut. The diameter of the spindle is 35 mm. The nut's inside diameter is 35 mm, its maximum outside diameter is 65 mm, and its length is 35 mm. The stopper rod outside diameter is 120 mm, its inside diameter is 35 mm, and its length is 1320 mm.

Figure 2A:
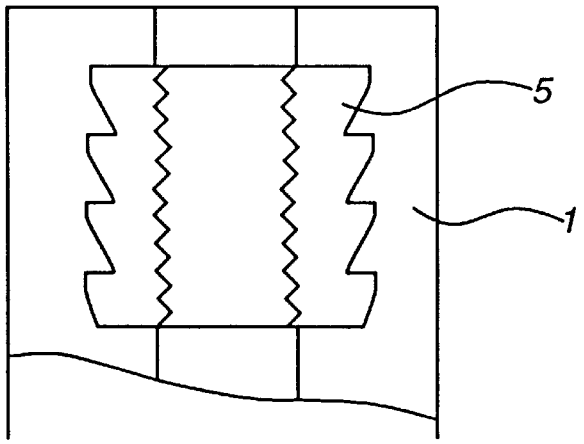
FIG. 2 is a sectional view showing configurations of nuts embedded in the body of a tundish stopper rod according to the present invention.
Figure 2B:
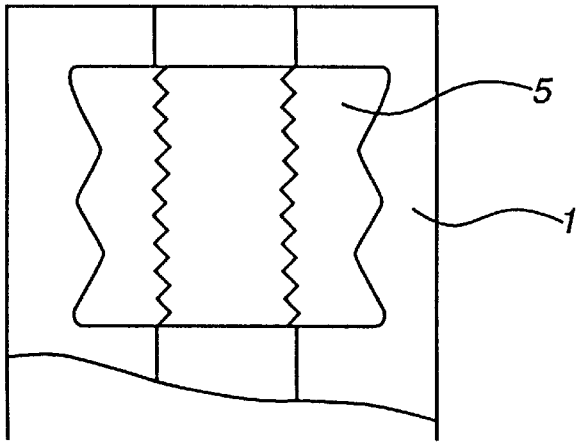
Figure 2C:
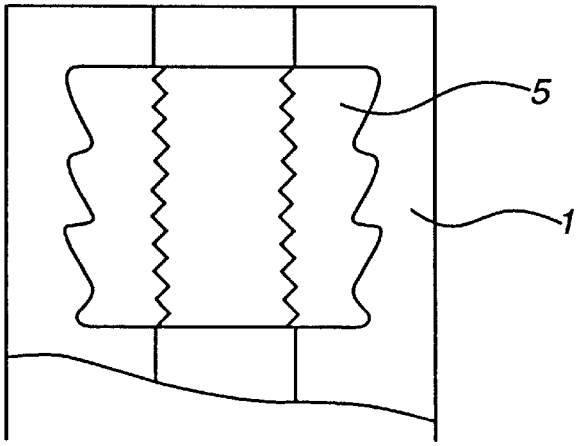
Figure 3:
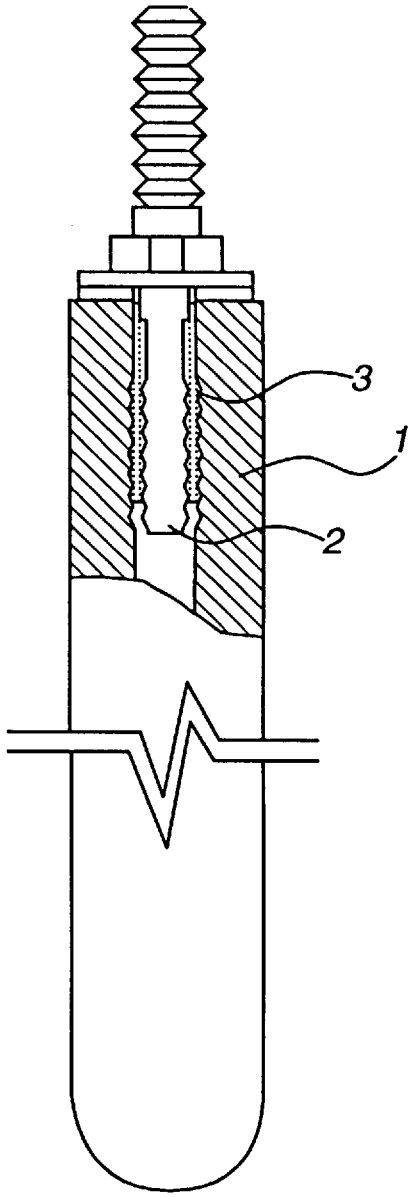
FIG. 3 (Prior Art)
FIG. 3 is a sectional view of a known tundish stopper rod for continuous casting.
Figure 4:
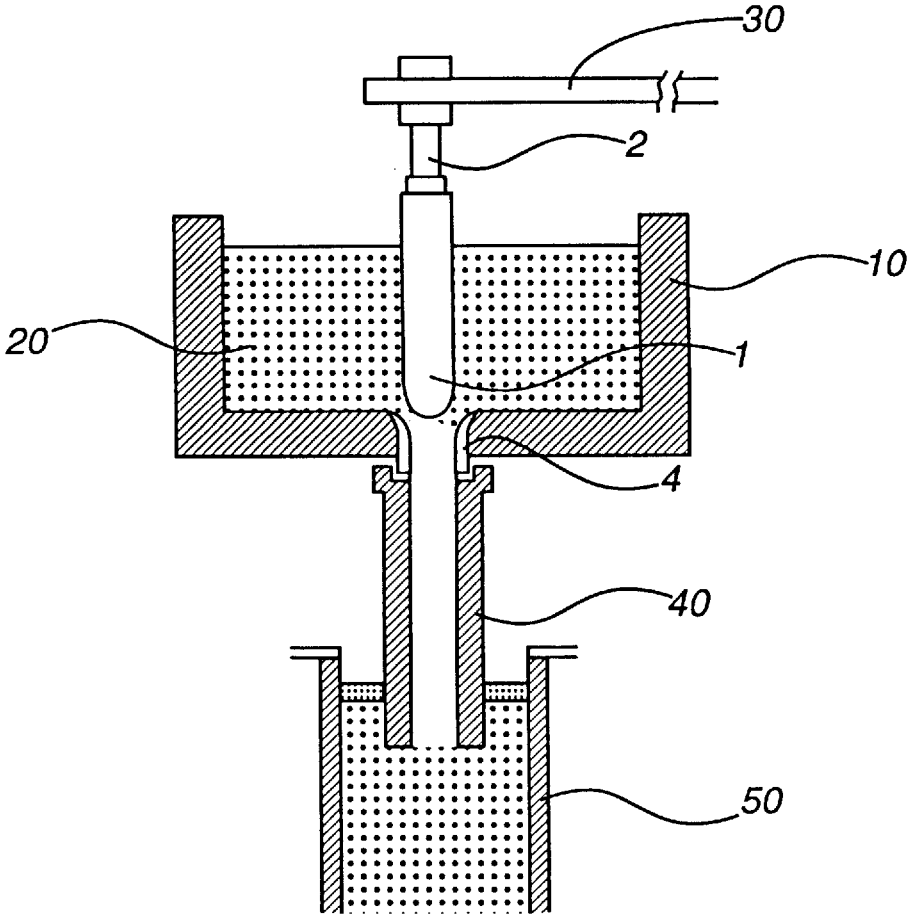
FIG. 4 is a sectional view showing a tundish and a tundish stopper rod for continuous casting and its peripheral portions in order to illustrate the function of the tundish stopper rod.

The outer face of the nut can take any shape other than the above mentioned shape, as long as, with the use of that shape, the integration of the stopper rod and the nut can be made easier and the nut can be prevented from coming off from the stopper rod. FIG. 2 shows examples of such shapes. The shape shown in FIG. 2(*a*) is aimed to give priority to the prevention of the nuts coming-off from the stopper rod. In the shape shown in FIG. 2(*b*), sharp-pointed projections are eliminated so that the stress concentration due to the difference between the thermal expansion coefficient of the nut and that of the stopper rod can be avoided. The shape shown in FIG. 2(*c*) is aimed to prevent both the coming off of the nuts from the stopper rod and the stress concentration due to the difference between the thermal expansion coefficients of the nut and that of the stopper rod.

The durability of a tundish stopper rod as shown in FIG. 1 was evaluated by applying the tundish stopper rod to continuous casting of molten steel. The temperature and the specific gravity of such molten steel are the highest of all the molten metals of continuous casting.

The stopper rods used in this evaluation were made of alumina-graphite material consisting essentially of 60 wt % alumina, 24 wt % graphite, 9.2 wt % $SiO_2$ and 4.7 wt % SiC. Alumina or Mullite was used as an engineering ceramic material of the nuts.

Alumina was formed into a nut by atmospheric pressure sintering and mullite was formed into a nut by reaction sintering. The bending strength of the alumina used for the nut was 100 MPa or higher at 500° C. and 150 MPa or higher at 1000° C. The bending strength of the mullite used for the nut was also 100 MPa or higher at 500° C. and 150 MPa or higher at 1000° C.

The average thermal expansion coefficient of the alumina-graphite of which the stopper rods were made was $4.5\times10^{-6}$/°C. The average thermal expansion coefficient of the alumina of which the nuts were made was $6.5\times10^{-6}$/°C. and was 1.44 times as high as that of the alumina-graphite. The average thermal expansion coefficient of the mullite of which the nuts were made was $4.3\times10^{-6}$/°C. and was 0.95 times as high as that of the alumina-graphite.

With the use of cold isostatic pressing (CIP), the stopper rods were integrally molded with the nuts made of alumina or mullite.

The performance of a tundish stopper rod according to the present invention was evaluated on the basis of a stopper-rod breakage rate which indicated the rate of the number of the stopper rods broken during one year to the total number of the stopper rods used during this one year. A "spindle recovery rate", which indicates the rate of the number of the spindles appropriately recovered and reused during one year to the number of the spindles used during this one year, is used for the evaluation of the performance. The results of the evaluation are listed in Table 1, together with the results obtained for a conventional tundish stopper rod attached to a spindle with the use of a known mortar and a conventional tundish stopper rod attached to a spindle with the use of a metal nut embedded in and integrally molded with the stopper rod.

In each of the embodiments of a tundish stopper rod according to the present invention, the stopper-rod breakage rate was zero or 0.1%. In contrast, each of the prior art tundish stopper rods had a stopper-rod breakage rate several times as high as that of each of the embodiments of a tundish stopper rod according to the present invention. Furthermore, in each of the embodiments of a tundish stopper rod according to the present invention, the spindle recovery rate was 98%. In contrast, the spindle recovery rate of each of the prior art examples using mortar was 32%. In those prior art examples using mortar, many spindles having threads, which had become deformed, were found in the evaluation. The prior art tundish stopper rods, in which a metal nut was embedded, revealed seizure between the stopper rod and the spindle which occurred in many cases and consequently, those seized spindles required repair.

As described hereinbefore, since a tundish stopper rod for continuous casting according to the present invention is integrally molded with an engineering-ceramic nut embedded in it, the stopper rod can be correctly fixed onto a spindle in a short time and can have a sufficiently high degree of heat resistance and mechanical strength to endure the mechanical impact of its harsh up-and-down movement. Furthermore, the deformation and seizure of the spindle can be avoided. The present invention has substantial labor-saving and resource-saving effects on the continuous casting of molten metals.

TABLE 1

| Article | Fitting Portion | Stopper-rod breakage rate | Spindle recovery rate |
|---|---|---|---|
| Embodiment | Alumina nut | 0% | 98% |
| | Mullite nut | 0.1% | 98% |
| Prior art | Mortar | 0.7% | 32% |
| | Steel nut | 0.6% | 60% |

We claim:

1. A tundish stopper rod for continuous casting, comprising:

(a) a stopper rod for regulating a flow rate of molten metal, which is poured from a tundish into a mold, said stopper rod defining an elongated opening and being supported by a spindle, said spindle made of steel, and (b) a nut for attaching said stopper rod onto said spindle, said nut being mechanically and directly attached to said stopper rod opening at the nut exterior surface and said nut being mechanically and directly attached to said spindle at the nut interior surface, said nut made of an engineering ceramic material and embedded in a body of said stopper rod.

2. A tundish stopper rod for continuous casting as defined in claim 1, in which a bending strength of said engineering ceramic material is at least 100 MPa.

3. A tundish stopper rod for continuous casting as defined in claim 1, in which an average thermal expansion coefficient of said engineering ceramic material is at most two times as high as that of said refractory material of said stopper rod.

4. A tundish stopper rod for continuous casting as defined in claim 2, in which an average thermal expansion coefficient of said engineering ceramic material is at most two times as high as that of said refractory material of said stopper rod.

5. A tundish stopper rod for continuous casting as defined in claim 3, in which said engineering ceramic material is alumina, mullite, silicon carbide, silicon nitride, sialon, zirconia or a composite material thereof.

6. A tundish stopper rod for continuous casting as defined in claim 3, in which said stopper rod is made of alumina-graphite.

7. A tundish stopper rod for continuous casting as defined in claim 4, in which said engineering ceramic material is alumina, mullite, silicon carbide, silicon nitride, sialon, zirconia or a composite material thereof.

8. A tundish stopper rod for continuous casting as defined in claim 4, in which said stopper rod is made of alumina-graphite.

9. A tundish stopper rod for continuous casting as defined in claim 7, in which said engineering ceramic material is alumina.

10. A tundish stopper rod for continuous casting as defined in claim 8, in which said engineering ceramic material is alumina.

* * * * *